US009848680B2

(12) United States Patent
Lynch

(10) Patent No.: US 9,848,680 B2
(45) Date of Patent: Dec. 26, 2017

(54) CONTACT LENS CASE HAVING INTEGRATED LENS DATA STOWAGE COMPARTMENTS

(71) Applicant: Marirose Charlene Lynch, Eastham, MA (US)

(72) Inventor: Marirose Charlene Lynch, Eastham, MA (US)

( * ) Notice: Subject to any disclaimer, the term of this patent is extended or adjusted under 35 U.S.C. 154(b) by 78 days.

(21) Appl. No.: 15/133,405

(22) Filed: Apr. 20, 2016

(65) Prior Publication Data

US 2016/0316873 A1 Nov. 3, 2016

Related U.S. Application Data

(60) Provisional application No. 62/155,927, filed on May 1, 2015.

(51) Int. Cl.

| | |
|---|---|
| ***F21V 33/00*** | (2006.01) |
| ***A45C 11/04*** | (2006.01) |
| ***A45C 15/06*** | (2006.01) |
| ***A45C 11/00*** | (2006.01) |

(52) U.S. Cl.

CPC ..... *A45C 11/005* (2013.01); *A45C 11/046* (2013.01)

(58) Field of Classification Search

CPC ..... A45C 11/005; A45C 11/046

See application file for complete search history.

(56) References Cited

U.S. PATENT DOCUMENTS

| | | | | | |
|---|---|---|---|---|---|
| 4,545,479 | A * | 10/1985 | Figari | A45C 11/005 | 132/286 |
| 4,942,959 | A * | 7/1990 | Sauber | A45C 11/005 | 134/137 |
| 5,224,593 | A * | 7/1993 | Bennett | A45C 11/005 | 206/210 |
| 5,396,984 | A * | 3/1995 | Wanders | A45C 11/005 | 206/210 |
| 7,832,551 | B2 * | 11/2010 | Newman | A45C 11/005 | 134/901 |
| 2006/0232426 | A1 * | 10/2006 | Sabeta | A45C 11/005 | 340/572.8 |
| 2012/0000798 | A1 * | 1/2012 | Thompson | A45C 11/005 | 206/5.1 |

* cited by examiner

*Primary Examiner* — Mariceli Santiago
(74) *Attorney, Agent, or Firm* — CUSPA Technology Law Associates; Yi Li

(57) ABSTRACT

A contact lens case having integrated lens data stowage compartments is provided. The contact lens case includes a left and a right bowl section in an upper portion of a case body for storing a pair of contact lenses, and two lens data stowage compartments in a lower portion of the case body. Each of the bowl section has a closed bottom and an open top detachably closed by a closure cap. Each lens data stowage compartment is positioned underneath one bowl section, and is assessable from a side or a lower base of the contact lens case. The height of the compartments is proportioned for receipt of a lens data sheet having thereon lens data corresponding to a contact lens located in the bowl section thereabove. The lens data stowed in each compartment can be viewed or accessed from the contact lens case.

20 Claims, 7 Drawing Sheets

CONTACT LENS CASE HAVING INTEGRATED LENS DATA STOWAGE COMPARTMENTS

CROSS REFERENCE TO RELATED APPLICATION

This application claims the benefit under 35 USC 119 (e) of the provisional patent application No. 62/155,927, filed May 1, 2015, which is hereby incorporated by reference in its entirety.

FIELD OF THE INVENTION

The present invention relates to a contact lens case, more specifically relates to a contact lens case with lens data stowage compartments integrated therein.

BACKGROUND OF THE INVENTION

Since the inception of contact lenses circa 1965, various strategies have been employed for the efficient and practical storage of contact lenses during periods of non-use thereof. In general, contact lens cases fall into two categories, namely, those employed for short term storage of lenses, typically not exceeding a day, and those for longer term storage. In the latter case, a larger quantity of saline or other suitable solution is required to assure thorough soakage and thereby cleaning of the hydrophilic contact lenses from debris or bacteria that they may have been acquired during a longer period of usage. In the case of contact lens cases of the first category, a smaller quantity of saline solution is required. However, regardless of the type of case required, a persistent problem has been that certain users will eventually lose or damage a particular contact lens and thereupon generally will not know the spherical or power measurement, axis, diameter, or other data about a lost or damaged lens, thereby requiring a visit to an optometrist in order to replace or reorder the contact lens.

Therefore, there is a need for providing contact lens users convenient storage and easy access to contact lens data for reordering or confirming their contact lens information. Moreover, there is a further need to improve indicia of existing contact lens case to reduce the likelihood of misplacement of a pair of contact lenses within a contact lens case.

SUMMARY OF THE INVENTION

In one embodiment, the present invention is directed to a contact lens case having integrated lens data stowage compartments. The contact lens case comprises a left and right bowl section in an upper portion of a case body, each of the bowl section having a closed bottom and an open top detachably closed by a closure cap, and two lens data stowage compartments in a lower portion of the case body, each compartment underneath one bowl section, assessable from a side or a lower base of the contact lens case, and the height of the compartments proportioned for receipt of a lens data sheet having thereon lens data corresponding to a contact lens located in the bowl section thereabove, whereby the lens data stowed in each compartment can be viewed or accessed from the contact lens case.

An object of the present invention is to provide a contact lens carrying case which has integrated lens data stowage compartments for convenient storage and retrieval of contact lens data. In the event of damage, loss or natural deterioration of a lens, one can readily obtain the characterizing data of the contact lens by inverting the carrying case and observing its relevant parameters in respective compartment or through the lower base of the contact lens case, or alternatively by viewing the lens data through a transparent bowl section.

Another object of the invention is to provide an alert to a case user upon removal of contact lens from an eye, as to which lens bowl a particular lens should be placed in, for example, using the color red from a light-emitting LED to denote a right lens bowl and a second color to denote the proper bowl placement of the other lens.

It is a further object to minimize the need for a visit to an optometrist in the event that a contact lens is damaged or lost, thereby facilitating ease of reordering of a lost contact lens.

The advantages of the present invention will become apparent from the following description taken in conjunction with the accompanying drawings showing exemplary embodiments of the invention.

BRIEF DESCRIPTION OF THE DRAWINGS

It is noted that in the drawings like numerals refer to like components.

DETAILED DESCRIPTION OF THE INVENTION

Figure 1:
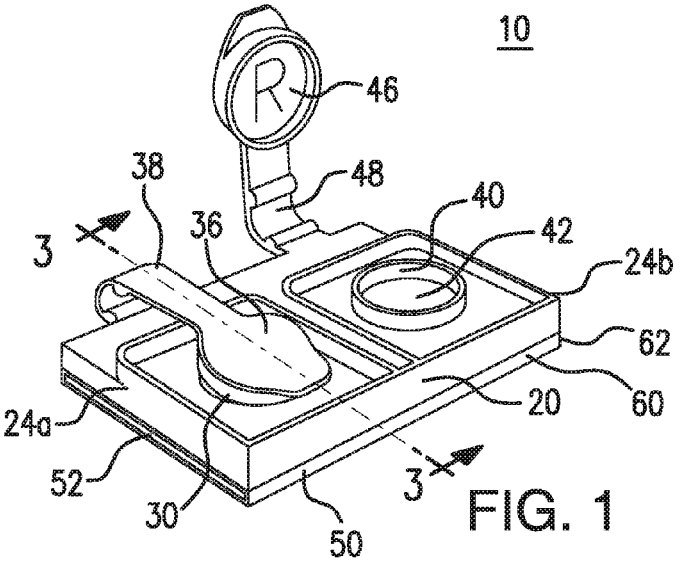
FIG. 1 is a perspective top view of a contact lens case in one embodiment of the present invention.
Figure 2:
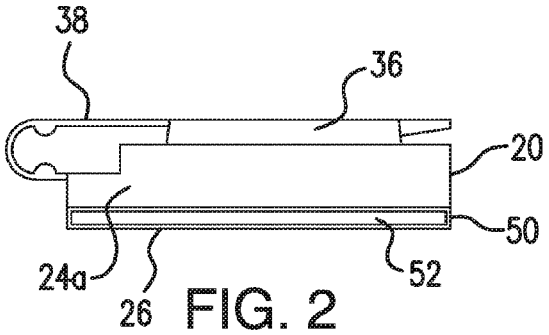
FIG. 2 is a side view of the contact lens case of FIG. 1, with the closure caps in a closed position.

Embodiments of the present invention generally relate to a contact lens case with lens data stowage compartments integrated therein. Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In some embodiments, the contact lens or ophthalmic case of the present invention has integrated lens data stowage compartments. The contact lens case includes a left and right bowl section in an upper portion of a case body for storing a pair of contact lenses and two lens data stowage compartments in a lower portion of the case body. Each of the bowl section has a closed bottom and an open top detachably closed by a closure cap. Each compartment is positioned underneath one bowl section, and is assessable from a side or a lower base of the contact lens case. The height of the compartments is proportioned for receipt of a lens data sheet having thereon lens data corresponding to a contact lens located in the bowl section thereabove. The lens data stowed in each compartment can be viewed or accessed from the contact lens case.

Figure 3:
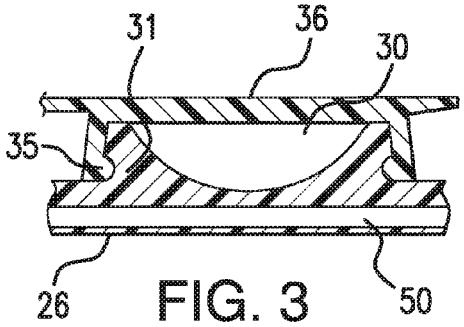
FIG. 3 is a fragmentary cross-sectional view taken through Line 3-3 of FIG. 1.
Figure 4:
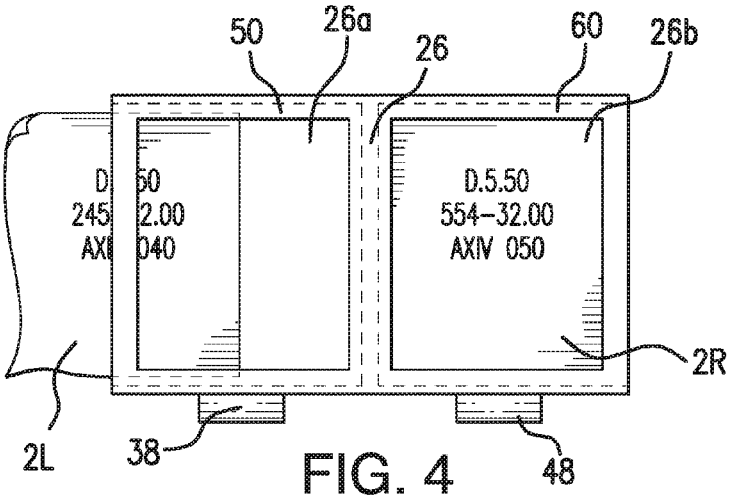
FIG. 4 is a bottom plan view of the contact lens case of FIG. 1, with a lens data sheet inserted in each lens data stowage compartment.
Figure 5A:
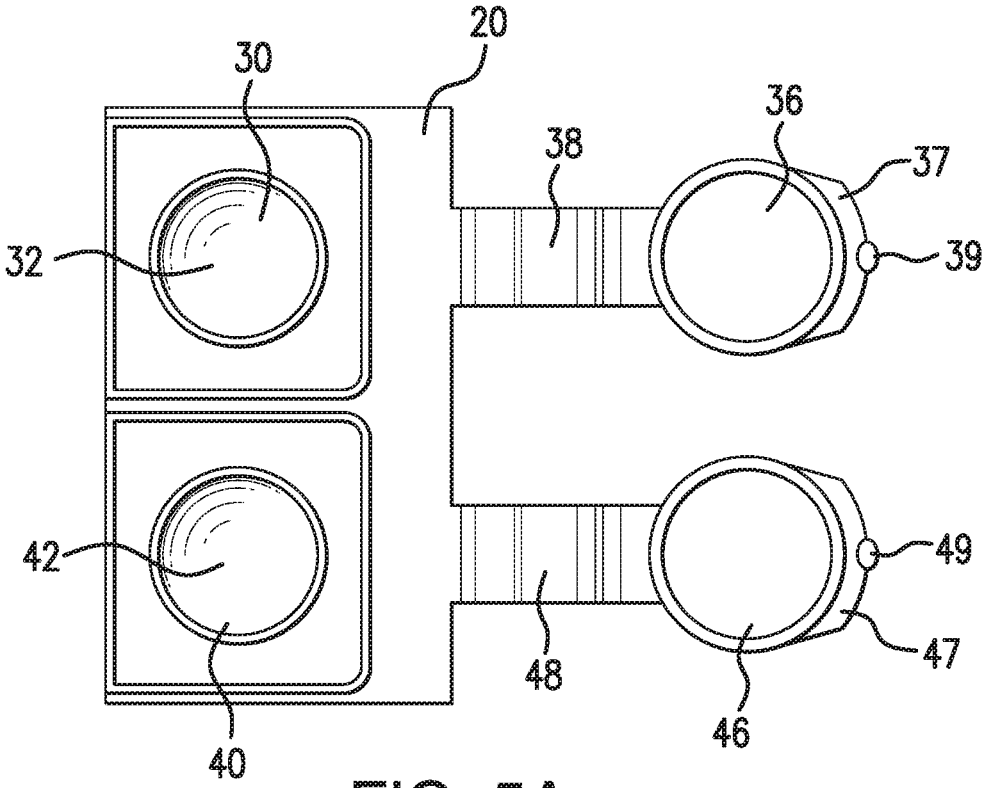
FIGS. 5A and 5B are top views of the contact lens case of FIG. 1 with additional LEDs, and with contact lens bowl closure caps in an open and a closed position, respectively.

Now referring to the drawings, FIGS. 1 to 4 illustrate a contact lens case 10 in one embodiment of the present invention. As shown, contact lens case 10 has a case body 20, and a left lens bowl or bowl section 30 and a right lens bowl or bowl section 40 in an upper portion of case body 20. Each bowl section 30, 40 has a closed bottom 32, 42 and an open top detachably closed by a closure cap 36, 46. As shown in FIGS. 3 and 5A, each bowl section 30, 40 has a curved bottom for convenience of retrieving a contact lens from a bowl section. Other known contact lens bowl shapes in existing contact lens cases can also be used for the bowl sections of the present invention. In the embodiment shown, each closure cap 36, 46 is connected to case body 20 by a strap 38, 48, and each closure cap 36, 46 snap fittably closes on respective bowl section. As shown in FIG. 3, a circumferential rim 35 on the inner edge of cap 36 snap-fits with a circumferential groove 31 of bowl section 30 to close the cap on to the bowl section.

The contact lens case 10 further includes two lens data stowage compartments, namely, a left compartment 50 and a right compartment 60 in the lower portion of case body 20. As shown in FIG. 1, the left compartment 50 is underneath the left bowl section 30, and the right compartment 60 is underneath the right bowl section 40. There is no passage or fluid communication between the bowl section and respective compartment underneath, see FIG. 3 also.

In the embodiment shown, case body 20 is in a form of generally rectangular, planar platform, with the bottommost of the case body forming a flat lower base 26 of the contact lens case. Each of the two compartments 50, 60 is in the form of a sleeve, formed by a short hollow segment immediately above the lower base 26 of case body 20. Each compartment has an opening in a form of elongated horizontal slot on one side of the platform. In the embodiment show, left compartment 50 has an opening 52 on the left side 24*a* of the case body and right compartment 60 has an opening 62 on the opposing side 24*b*. Alternatively, a similar opening of the compartment can also be positioned at the front or rear side of the case body. Two compartments are separated from each other by a partition at the middle of the hollow segment. The height of compartments 50, 60 is proportioned for receipt of a lens data sheet. The lens data sheet has printed thereon lens data corresponding to a contact lens located in the bowl section thereabove and can be inserted into respective compartment through its opening.

The lens data sheet may be in the form of aluminum foil, plastic or paper label, film, or membrane, and has printed thereon of lens data for one corresponding contact lens. The lens data can be printed on one surface or both surfaces of the lens data sheet. For the purpose of the present invention, the lens data may include prescription of the contact lens for respective eye, curvature of the contact lens, diameter of the contact lens, and/or other desired contact lens related information. The lens data is typically provided on the contact lens holding vial by the manufacturer. A foil or the like containing lens data may be readily removed from the original lens holding vial and placed into the lens data stowage compartment underneath corresponding bowl section into which the contact lens is to be kept. The lens data sheet may be cut by the user to fit into a compartment. In contact lens case 10, the lens data sheets for a pair contact lenses can be inserted into compartments 50, 60 through their respective openings 52, 62 described above.

In some embodiments, the lower base 26 of case body 20 includes a transparent display area overlaid with the two compartments 50, 60. Alternatively, the lower base 26 may include two transparent display areas 26*a*, 26*b*, each overlaid with one compartment, see FIG. 4. As further illustrated in FIG. 4, two lens data sheet 2L, 2R for a pair contact lenses are inserted into respective compartment 50, 60 with the lens data facing transparent display areas 26*a*, 26*b* of the lower base 26, respectively. As such, when contact lens case 10 is inverted, the information on each lens data sheet can be viewed through the transparent display areas.

In a further embodiment, the transparent display area of the lower base 26 may be a magnifying surface. The lens data can be more easily viewed through the magnifying surface by the user or contact lens vendor for reordering the same contact lenses.

In another embodiment, the case body 20 may be made of a transparent material, and the lens data on lens data sheets placed in compartments 50, 60 can be viewed from the upper side of the contact lens case through transparent bowl sections when the closure caps are removed. Known transparent plastic material compatible with contact lens and contact lens solutions can be used for the case body. In this embodiment, the lens data on lens data sheets may be orientated to face the bowl sections. As can be appreciated, in this configuration the lens data underneath the transparent bowl sections can also be used as an indicia for respective contact lens. Alternatively, the lens data sheets may have the lens data on both surfaces, and the lens data may be viewed through either the bowl sections or the lower base of the contact lens case.

Figure 5B:
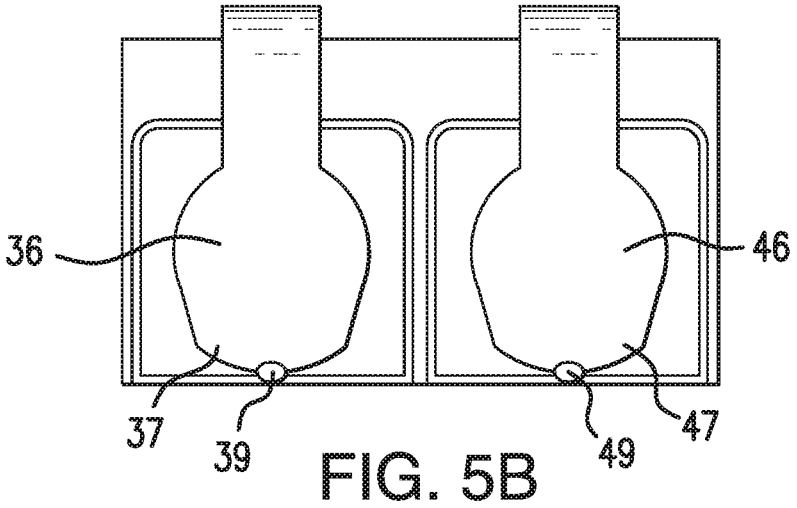

FIGS. 5A and 5B show an optional further feature of the contact lens case 10. As shown in FIG. 5A, each closure cap 36, 46 includes a front edge 37, 47 for engagement with user's fingers for opening a closed bowl section. In the embodiment shown in FIGS. 5A and 5B, contact lens case 10 may further include a pressure-responsive chromatically discreet LED 39, 49 positioned at the front edge 37, 47 of each closure cap 36, 46. Each LED emits a visible light of a specific color in response to engagement of user's fingers on edges 37, 47. However, the light emitted by the two LEDs have different colors, for example, LED 39 associated with the left bowl section 30 emits a blue color and LED 49 associated with the right bowl section 40 emits a red color. The distinct color helps the user recognize a specific bowl section, particularly after removal of the contact lenses from the eyes, which reduces the likelihood of misplacement of contact lenses.

Figure 6A:
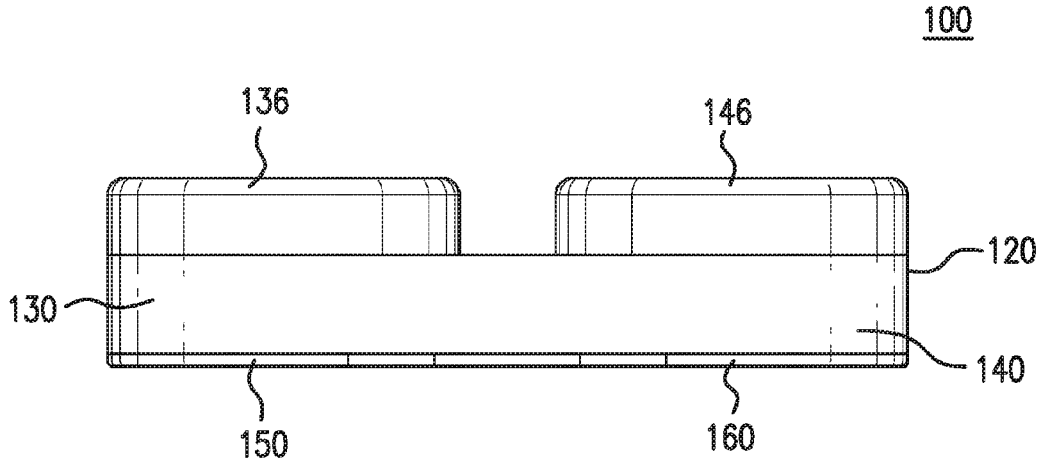
FIG. 6A is a front elevational view of a contact lens case in a further embodiment of the present invention.
Figure 6B:
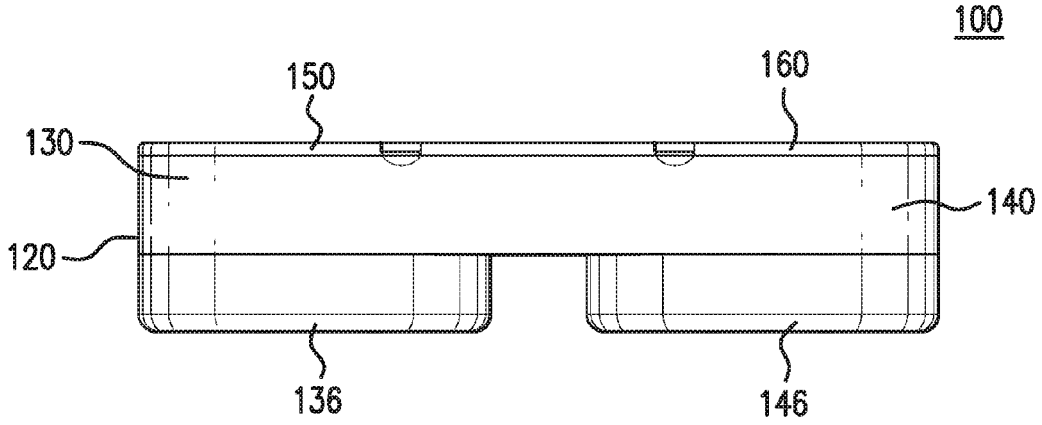
FIG. 6B is an elevational view of the contact lens case shown in FIG. 6A with the contact lens case inverted, with the rear side of the contact lens case facing the front.

FIGS. 6A to 9 illustrate a contact lens case 100 in a further embodiment of the present invention. As shown in FIG. 6A, contact lens case 100 has a case body 120, and a left bowl section 130 and a right bowl section 140 in the upper portion of case body 120. Same as in contact lens case 10 described above, each bowl section 130, 140 has a closed bottom, and an open top detachably closed by a closure cap 136, 146. The contact lens case 100 further includes two lens data stowage compartments 150, 160 in the lower portion of case body 120. The left compartment 150 is underneath the left bowl section 130, and the right compartment 160 is underneath the left bowl section 130. FIG. 6B shows contact lens case 200 is inverted with the rear bottom of the contact lens case facing upper front.

Figure 7:
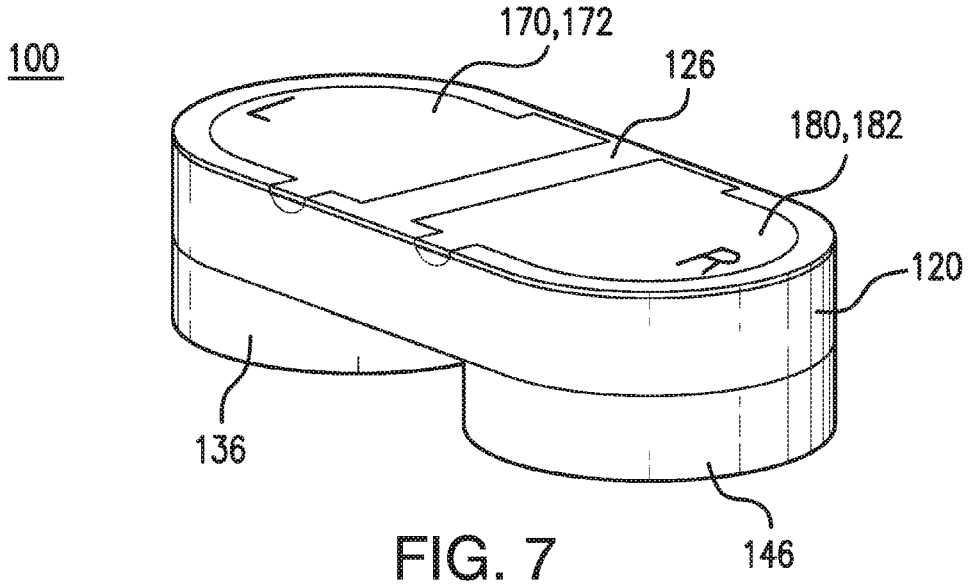
FIG. 7 is a perspective rear bottom view of the contact lens case of FIG. 6, with the lids of the lens data stowage compartments in a closed position.
Figure 8:
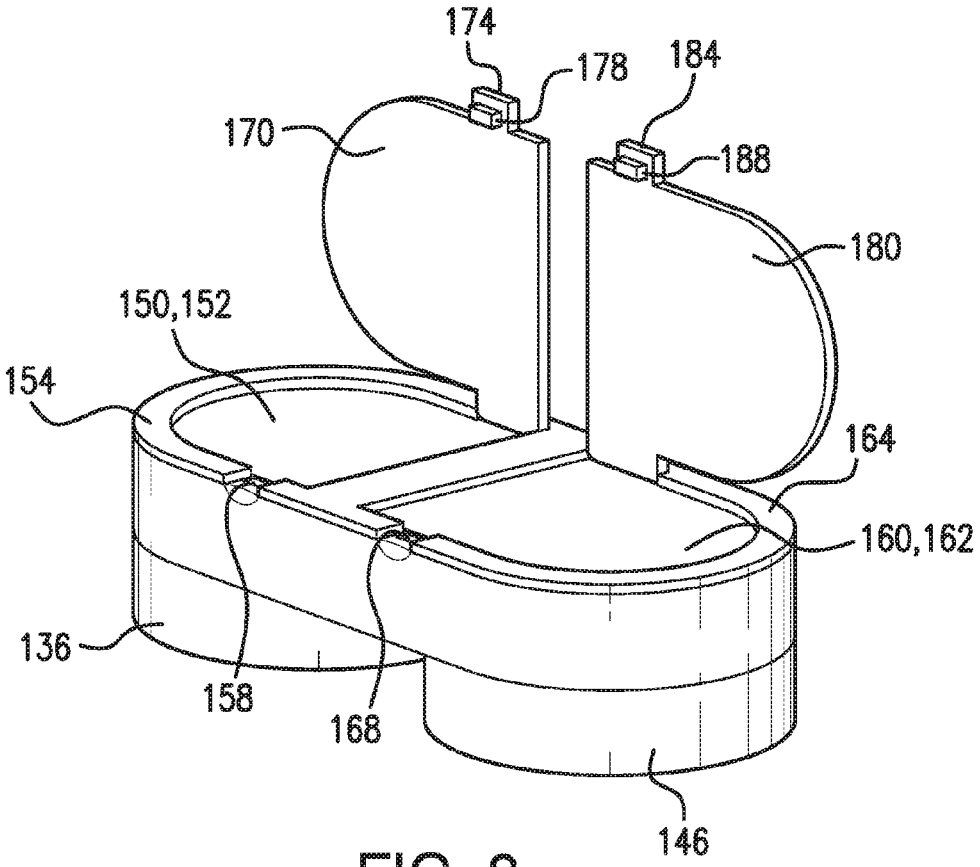
FIG. 8 is a perspective rear bottom view of the contact lens case of FIG. 6, with the lids of the lens data stowage compartments in an open position.

As shown in FIG. 8, each lens data stowage compartment 150, 160 is formed by a circumferential edge 154, 164 at the bottom of case body 120, and each compartment has a base 152, 162. There is no passage or fluid communication between the compartment and respective bowl section thereabove. The height of compartments 150, 160 is proportioned for stowing a lens data sheet described above. As further shown in FIGS. 7 and 8, each of the two lens data stowage compartments 150, 160 is closed by a lid 170, 180, which forms at least part of the lower base 126 of the contact lens case. Each lid 170, 180 is configured to close or open a respective compartment. When lids 170, 180 are closed, each lid seals respective compartment. As shown in FIG. 8, when a lid is opened, respective compartment becomes accessible for receipt of a lens data sheet, or for viewing a lens data sheet if it is already placed into the compartment.

Figure 9:
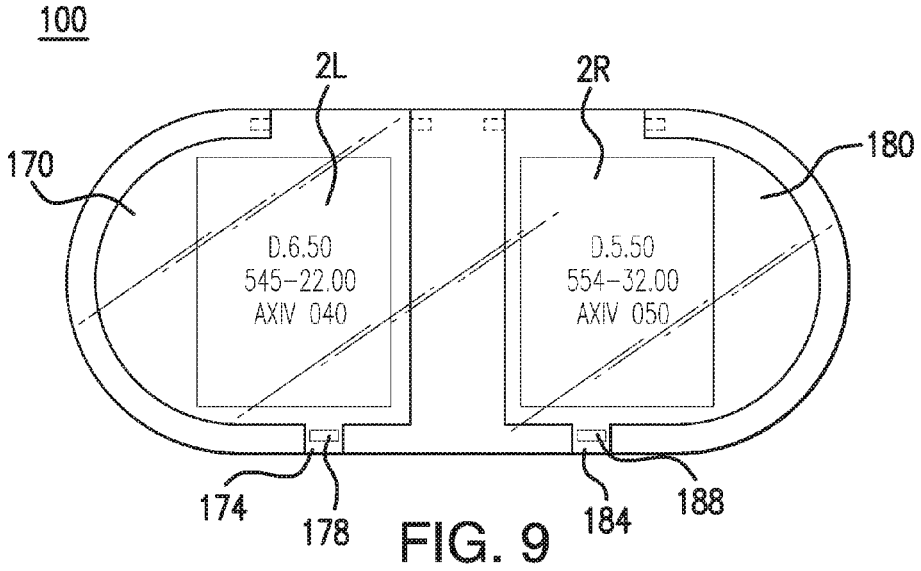
FIG. 9 is a bottom plan view of the contact lens case of FIG. 6, showing a lens data sheet placed in each lens data stowage compartment.

Each lid 170, 180 may have a planar part 172, 182 complementary to size and shape of respective compartment and has one side thereof pivotally connected to a portion of circumferential edge 154, 164 or to the case body, see FIGS. 8 and 9. Optionally, each lid may have a circumferential rim on the inner side of the lid to further seal a closed compartment.

Each lid 170, 180 and respective compartment 150, 160 have a locking or closure mechanism to secure a closed lid to respective compartment. In the embodiment shown in FIGS. 8 and 9, there is a cut in the circumferential edge 154, 164 of each compartment 150, 160 and a slot or recess 158, 168 beneath the cut. Each lid 170, 180 has a lip 174, 184 corresponding to the location of the cut in the circumferential edge 154, 164 and complementary to the cut of the circumferential edge 154, 164. Each lip 174, 184 has a protruding rib 178, 188 on its inner side, which is in mating relationship of a friction lock with slot or recess 158, 168. As such when each lid 170, 180 is closed, each slot 158, 168 crimps respective rib 178, 188 to lock the lid in the closed position. Other suitable locking mechanisms, such as snap fit, pressure fit and other forms of friction lock, can also be used for locking the lids in closed position.

As shown in FIGS. 7 and 9, the planar parts 172, 182 of closed lids 170, 180 form parts of the lower base 126 of contact lens case 100. In some embodiments, the lids may be made of a non-transparent plastic, and a lens data sheet placed in a respective compartment can be viewed by opening the lid. In other embodiments, the lids may be made of a transparent plastic, and the lens data on lens data sheets 2L, 2R can be viewed through lids 170, 180 by simply inverting the contact lens case 100, as illustrated in FIG. 9. In such embodiment, the lids function as transparent display areas. In a further embodiment, each lid may include a magnifying surface for viewing the information on the lens data sheet disposed in respective compartment.

Moreover, one or both lids 170, 180 may further include an indicia for respective compartment corresponding to the left or right bowl section thereabove, see FIG. 7. The indicia may be a letter L or R, or a symbol, and the indicia may be placed on the external surface, internal surface or both of the lid.

To prevent loss of the lens data sheets, or misplacement of the lens data sheets between the two compartments when accessing the information, each lens data sheet may be secured to the base of the compartment or to the internal surface of the lid with an adhesive or the like. If the lid has a transparent display area, the lens data sheet is orientated with the lens data facing the transparent display area. Alternatively, if the bowl section is transparent for viewing the lens data therethrough, the lens data sheet may be orientated with the lens data facing the bowl section. As described above, optionally the lens data may be provided on both surfaces of a lens data sheet and the lens data can be viewed through the transparent display area of the lid and through a transparent bowl section.

Figure 10:
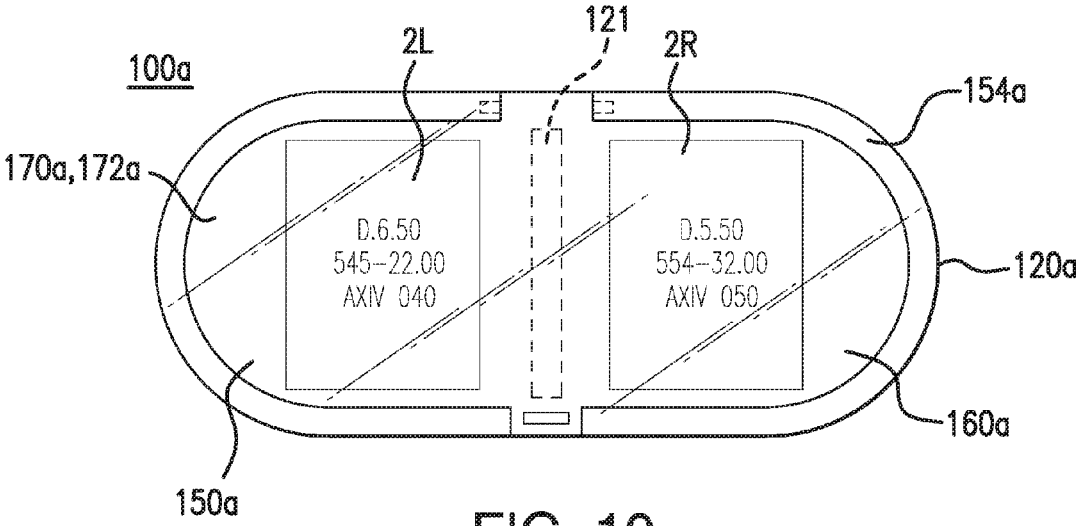
FIG. 10 is a bottom plan view of a variation of the contact lens case shown in FIGS. 6-9, showing a lens data sheet placed in each lens data stowage compartment.
Figure 11:
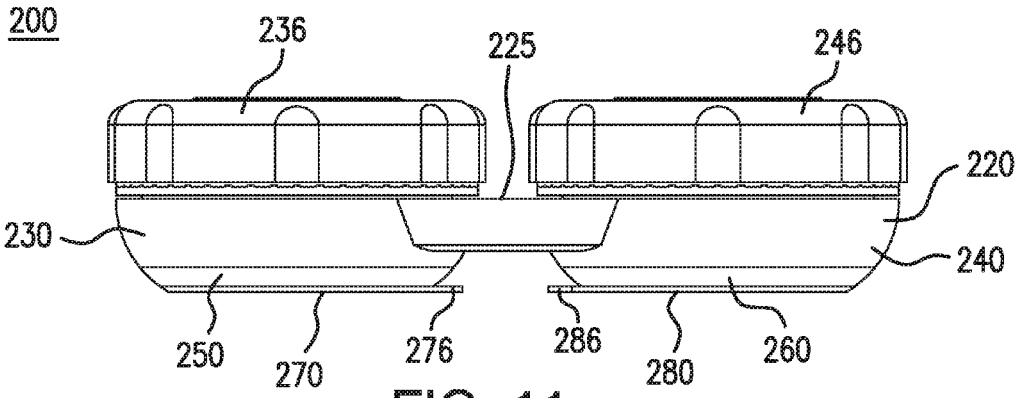
FIG. 11 is a front elevational view of a contact lens case in another embodiment of the present invention.

In the embodiment shown in FIGS. 6A-9, each compartment has its own lid. In an alternative embodiment as shown in FIG. 10, contact lens case 100*a* has one lid 170*a* which seals both lens data stowage compartments 150*a* and 160*a*. The closed lid 170*a* forms parts of the lower base of contact lens case 100*a*. In this embodiment, the two compartments 150*a* and 160*a* may be formed by a circumferential edge 154*a* on the bottom of case body 120*a* with a partition 121 at the middle to separate the two halves. Lid 170*a* has a planar part 172*a* complementary to size and shape of periphery of two compartments and has one side thereof pivotally connected to a portion of circumferential edge 154*a*. The contact lens case 100*a* may have the same locking mechanisms described above in contact lens case 100.

Similar to contact lens case 100, planar part 172*a* of lid 170*a* may include one transparent area overlaid with the two compartments for viewing the information on the lens data sheets. Alternatively, lid 170*a* may include two transparent areas, each overlaid with one compartment. Each transparent area may include a magnifying surface. Moreover, lid 170*a* may further include an indicia for one or both compartments corresponding to the left or right bowl section thereabove. For example, the letter L and R can be placed on the left side and right side of lid 170*a*, on the external surface, internal surface or both surfaces of the lid.

FIGS. 11 to 14 illustrate contact lens case 200 in a further embodiment of the present invention. As shown, contact lens case 200 has a left bowl section 230 and a right bowl section 240 in the upper portion of case body 220. The case body 220 includes a bridge section 225 joining the left and right bowl sections. Each bowl section 230, 240 has a closed bottom, and an open top detachably closed by a closure cap 236, 246. The contact lens case 200 further includes two lens data stowage compartments 250, 260 in the lower portion of the case body. The left compartment 250 is underneath the left bowl section 230, and the right compartment 260 is underneath the left bowl section 230. There is no passage or fluid communication between the compartment and respective bowl section thereabove. The height of compartments 250, 260 is proportioned for stowing a lens data sheet described above.

Figure 12:
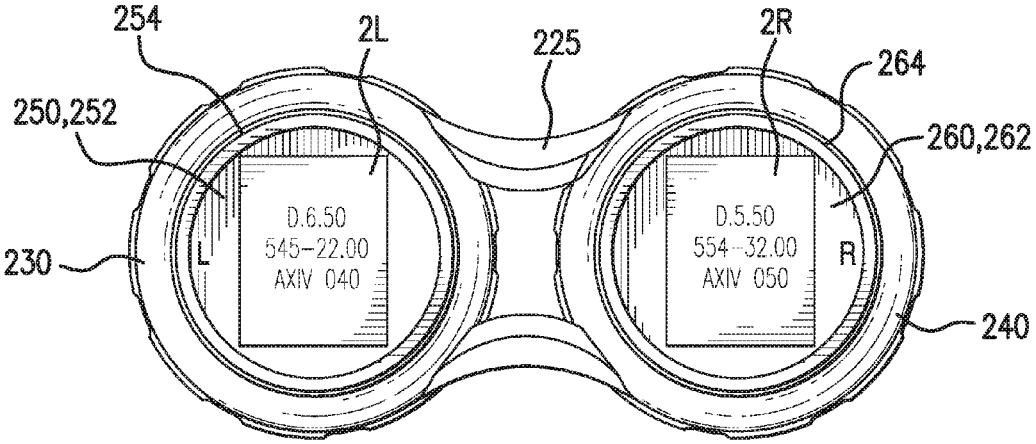
FIG. 12 is a bottom view of the contact lens case of FIG. 11, with the lids of the lens data stowage compartments removed.
Figure 13:
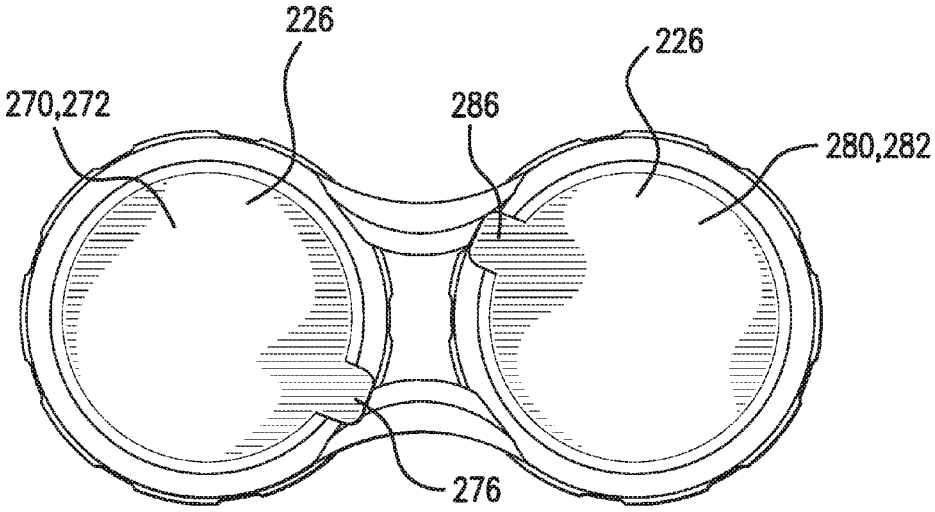
FIG. 13 is a bottom view of the contact lens case of FIG. 11, with the lids of the lens data stowage compartments in a closed position.

Different from the embodiments described above, in contact lens case 200 the two lens data stowage compartments 250, 260 are substantially spaced apart, and each is on one side of bridge section 225. As shown in FIG. 12, in the embodiment shown each compartment 250, 260 is formed by a circular circumferential edge 254, 264 on the bottom of case body 220 on one side of the bridge section and each compartment has a planar base 252, 262. As shown in FIG. 13, each of the two lens data stowage compartments 250, 260 is closed by a lid 270, 280. The closed lids 270, 280 form the lower base 226 of contact lens case 200. When a lid is removed, respective compartment becomes accessible for receipt of a lens data sheet, or for viewing a lens data sheet if it is already placed into the compartment.

As further shown in FIG. 13, each lid 270, 280 has a planar area 272, 282 complementary to size and shape of respective compartment, and a lip 276, 286 on the outer edge of the lid. In the embodiment shown, each lid 270, 280 may have on the inner side a periphery rim in a mating relationship with the circular circumferential edge 254, 264 of respective compartment. Each lid 270, 280 can be secured to the circular circumferential edge 254, 264 of respective compartment by pressure fitting. Other known closure mechanisms can be used in contact lens case 200, for example snap fitting, friction fitting and other pressure fitting structures such as those used in TupperWare container. The lids can be made of a suitable plastic material, which may have a certain extent of flexibility for pressure fitting closure. In some embodiments, the lids may be made of an elastomeric material, which provides a better sealing of the compartments from moisture and water. In the embodiment shown in FIG. 13, lips 276, 286 may be positioned underneath the bridge section 225, which allows the lips to have a reasonable size for easy gripping by the user without inconvenience associated with protrusion of the lips. Alternatively, the lids may also be in the form of screw cap complementary to threads placed on the external periphery of the circular circumferential edge of the compartments.

Figure 14:
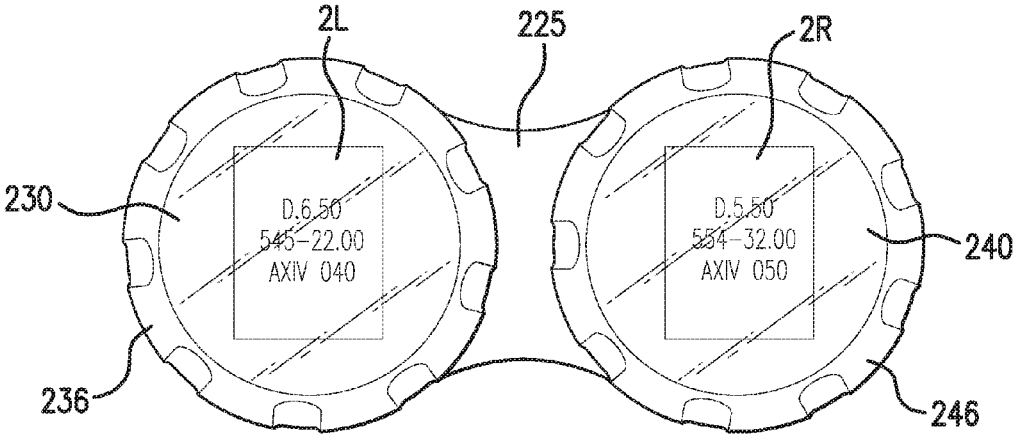
FIG. 14 is a top view of the contact lens case of FIG. 11, showing two lens data sheets in the lens data stowage compartments facing the bowl sections.

FIG. 14 illustrates a case body 220 and closure caps 236, 246 made of a transparent plastic, and two lens data sheets 2L and 2R for a pair of contact lenses are placed in compartments 250, 260, respectively, with the lens data facing the bowl sections. In the embodiment shown, the closure caps 236, 246 are also transparent and the lens data can be seen through the transparent bowl sections and closure caps. However, the closure caps 236, 246 can be non-transparent and upon removal of the closure caps, the lens data can be viewed through the transparent bowl sections. Alternatively, each of lids 270, 280 may have a transparent display area, through which the lens data orientated facing the lid may be viewed by inverting contact lens case 200.

The case body in the embodiments described above may be made of a suitable plastic material, such as polyethylene, by plastic molding. The material forming the bowl sections is compatible with contact lens and contact lens solution. Existing contact lens plastic materials can be used for the purpose of the present invention. The caps and lids of the contact lens case may be made of the same plastic material, or a different material. In some embodiments, the lids connected to the case body may be made by plastic molding into an integral part of the case body. In some embodiments, the lids and/or the case body may be made of a transparent or translucent material.

As can be appreciated, the height of the lens data stowage compartments only needs to sufficient for stowing the lens data sheet, which is typically in the form of aluminum foil or plastic film. As such, the height of the compartments is substantially less than the height or depth of the bowl section, see FIGS. 3, 8, and 11. In some embodiments, the height of the compartments is from one third to one tenth of the depth of the bowl section. Therefore, integration of the lens data stowage compartments in the instant contact lens case does not substantially alter the size of the contact lens case. In the horizontal plane, the lens data stowage compartments may assume various shapes, such as square, rectangular, circular, oval or other suitable shapes, depending on the case body shapes.

The contact lens case of the present invention is particularly advantageous for the users to store and to access the lens data for reordering. In the event of loss or damage of a contact lens, the user can conveniently retrieve the lens data by opening corresponding lens data stowage compartment, or directly view through a transparent lower base of the contact lens case, or view through a transparent bowl section of the contact lens case. This avoids an unnecessary trip to visit an optometrist and cost associated with it. Moreover, contact lens users usually maintain easy access to their contact lens case on a daily basis. Therefore, it is more convenient and less time consuming to retrieve lens data from the instant contact lens case than to find the same information saved in files or on computer.

Furthermore, the present invention also addresses the problem of inadvertent misplacement of the lens of one eye into the lens bowl within the contact lens case, intended for the other eye. Therefore, two common problems of contact lens users are herein addressed by the instant contact lens case.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. A contact lens case having integrated lens data stowage compartments, the contact lens case comprising:

a left and right bowl section in an upper portion of a case body, each of the bowl section having a closed bottom and an open top detachably closed by a closure cap; and two lens data stowage compartments in a lower portion of the case body, each compartment underneath one bowl section, assessable from a side or a lower base of the contact lens case, and the height of the compartments proportioned for receipt of a lens data sheet having thereon lens data corresponding to a contact lens located in the bowl section thereabove;

whereby the lens data stowed in each compartment can be viewed or accessed from the contact lens case.

2. The contact lens case of claim 1, wherein said lens data comprises prescription of the contact lens for respective eye, curvature of the contact lens, diameter of the contact lens, or other desired contact lens related information.

3. The contact lens case of claim 1, wherein each lens data stowage compartment is in a form of sleeve, and includes an opening on one side of the case body for inserting the lens data sheet therein.

4. The contact lens case of claim 3, wherein the lower base of the contact lens case comprises at least one transparent display area overlaid with the two lens data stowage compartments, whereby the lens data sheet stowed in each lens data stowage compartment can be viewed through the lower base by inverting the contact lens case.

5. The contact lens case of claim 4, wherein the lower base of the case body comprises two transparent display areas, each overlaid with one of the lens data stowage compartments.

6. The contact lens case of claim 4, wherein the at least one transparent display area is a magnifying surface.

7. The contact lens case of claim 1, wherein the lower base of the contact lens case comprises at least one lid configured to close or open the lens data stowage compartments.

8. The contact lens case of claim 7, wherein the at least one lid and the lens data stowage compartments have a locking mechanism to secure closure of the lid on the lens data stowage compartments.

9. The contact lens case of claim 7, wherein the at least one lid has a transparent display area overlaid with the two lens data stowage compartments.

10. The contact lens case of claim 9, wherein the transparent display area is a magnifying surface.

11. The contact lens case of claim 7, wherein the at least one lid includes an indicia for each lens data stowage compartment corresponding to the left or right bowl section thereabove, and the indicia is disposed on the external surface, internal surface or both surfaces of the at least one lid.

12. The contact lens case of claim 7, wherein the lower base of the case body comprises two lids, each lid configured to close or open one lens data stowage compartment.

13. The contact lens case of claim 12, wherein each lid and respective lens data stowage compartment have a locking mechanism to secure closure of the lid on respective lens data stowage compartment.

14. The contact lens case of claim 12, wherein each lid has a transparent display area.

15. The contact lens case of claim 12, wherein at least one of the lids includes an indicia corresponding to respective bowl section thereabove, and the indicia is disposed on the external surface, internal surface or both surfaces of the lid.

16. The contact lens case of claim 1, wherein the contact lens case further comprises two lens data sheets, each lens data sheet disposed in respective lens data stowage compartment corresponding to a contact lens located in the bowl section thereabove.

17. The contact lens case of claim 16, wherein the lens data on the lens data sheet is orientated facing the lower base of the contact lens case, and the lens data can be viewed through a transparent display area of the lower base.

18. The contact lens case of claim 16, wherein the case body is made of a transparent material, and wherein the lens data on each lens data sheet is orientated facing respective bowl section, and the lens data can be viewed through respective bowl section.

19. The contact lens case of claim 1, wherein the height of the lens data stowage compartments is less than one third of the depth of the bowl section.

20. The contact lens case of claim 1, wherein the lens case further comprises a pressure-responsive chromatically discreet LED positioned at an edge of each closure cap, said edge engageable by fingers of a user of the contact lens case, wherein a visible light of a first color is emitted upon engagement of said edge of the closure cap closed on the left bowl section, and a visible light of a second color is emitted upon engagement of said edge of the closure cap closed on the right bowl section.

* * * * *